US008816907B2

(12) United States Patent
Beaudin

(10) Patent No.: US 8,816,907 B2
(45) Date of Patent: Aug. 26, 2014

(54) SYSTEM AND METHOD FOR HIGH PERFORMANCE BEAM FORMING WITH SMALL ANTENNA FORM FACTOR

(75) Inventor: Steve Andre Beaudin, Ottawa (CA)

(73) Assignee: Blinq Wireless Inc., Ottawa, Ontario (CA)

( * ) Notice: Subject to any disclaimer, the term of this patent is extended or adjusted under 35 U.S.C. 154(b) by 417 days.

(21) Appl. No.: 13/290,659

(22) Filed: Nov. 7, 2011

(65) Prior Publication Data

US 2012/0133557 A1 May 31, 2012

Related U.S. Application Data

(60) Provisional application No. 61/411,033, filed on Nov. 8, 2010.

(51) Int. Cl.
*H01Q 3/00* (2006.01)

(52) U.S. Cl.
USPC ..... 342/368

(58) Field of Classification Search
CPC ..... H01Q 3/00
USPC ..... 342/368
See application file for complete search history.

(56) References Cited

U.S. PATENT DOCUMENTS

| | | | | |
|---|---|---|---|---|
| 3,855,597 | A * | 12/1974 | Carlise | 343/768 |
| 8,233,554 | B2 * | 7/2012 | Karabinis | 375/260 |
| 2003/0151551 | A1 * | 8/2003 | Chen et al. | 342/372 |
| 2009/0109351 | A1 * | 4/2009 | Shiomi | 348/790 |
| 2009/0315794 | A1 * | 12/2009 | Alamouti et al. | 343/753 |
| 2010/0141479 | A1 * | 6/2010 | Arnold et al. | 340/936 |
| 2010/0227646 | A1 * | 9/2010 | Ogawa et al. | 455/562.1 |
| 2012/0083317 | A1 * | 4/2012 | Athley et al. | 455/562.1 |
| 2012/0139797 | A1 * | 6/2012 | Fukuda | 343/700 MS |

* cited by examiner

*Primary Examiner* — Harry Liu
(74) *Attorney, Agent, or Firm* — Ridout & Maybee LLP; Angela de Wilton

(57) ABSTRACT

An antenna arrangement, a system, and method are provided for implementing a wireless communication module capable of performing adaptive beam forming, with a small antenna sail area. The antenna has a large horizontal to vertical aspect ratio. The antenna module is designed to include very few, or potentially a single radiating element in the vertical direction, and many elements in the horizontal direction, in order to create narrow beam in the azimuth plane, while maintaining a small sail area. The novel form factor advantageously provides for reduced wind loading, and for less conspicuous installations on buildings or towers, for example. The module is anticipated to find widespread applications in LOS and NLOS backhaul applications, and other wireless links between stationary nodes.

26 Claims, 12 Drawing Sheets

System Block Diagram

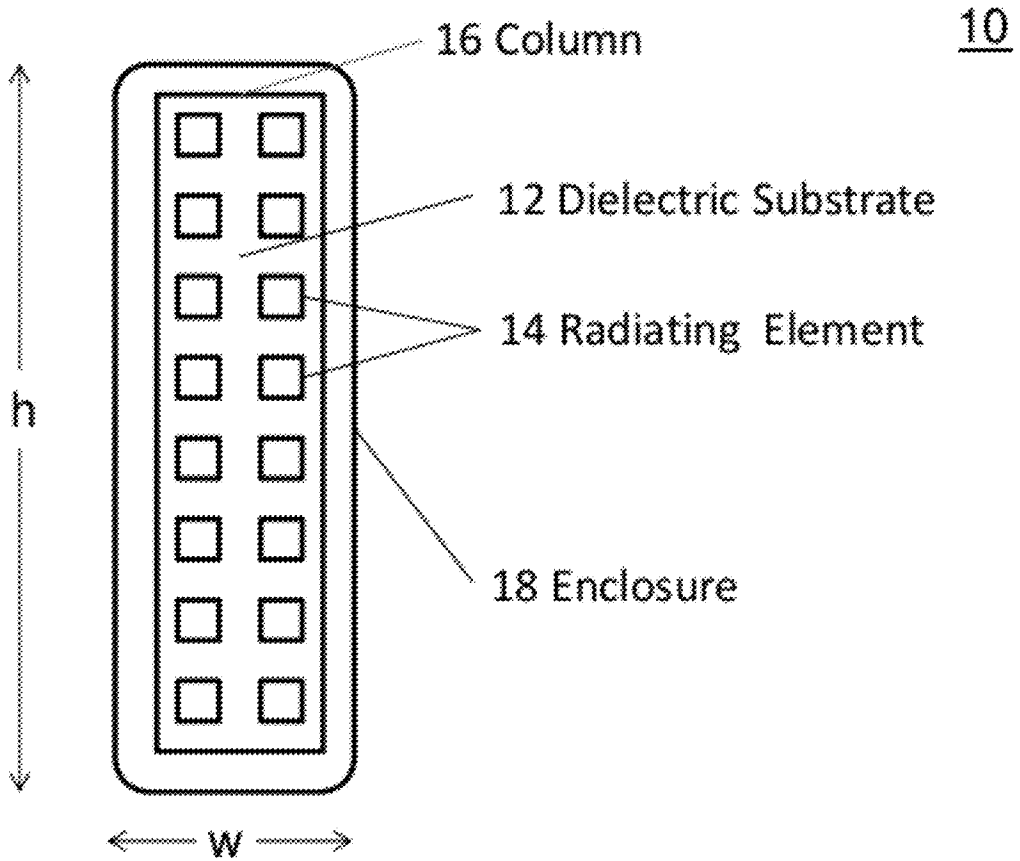
Figure 1: Typical Sector Antenna for Wireless Base Station (Prior art)

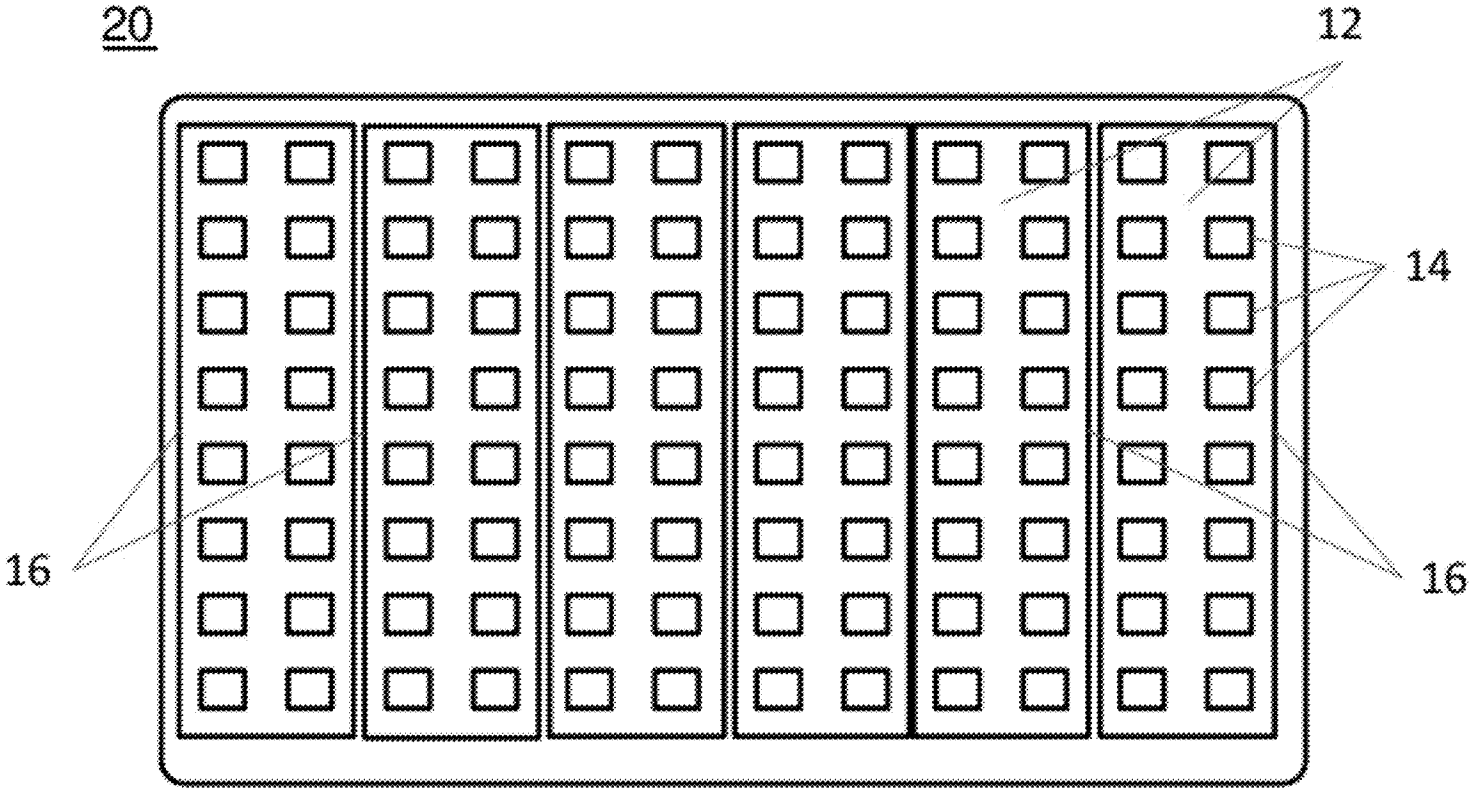
Figure 2: Six-Column Antenna Panel for Beam Forming (Prior Art)

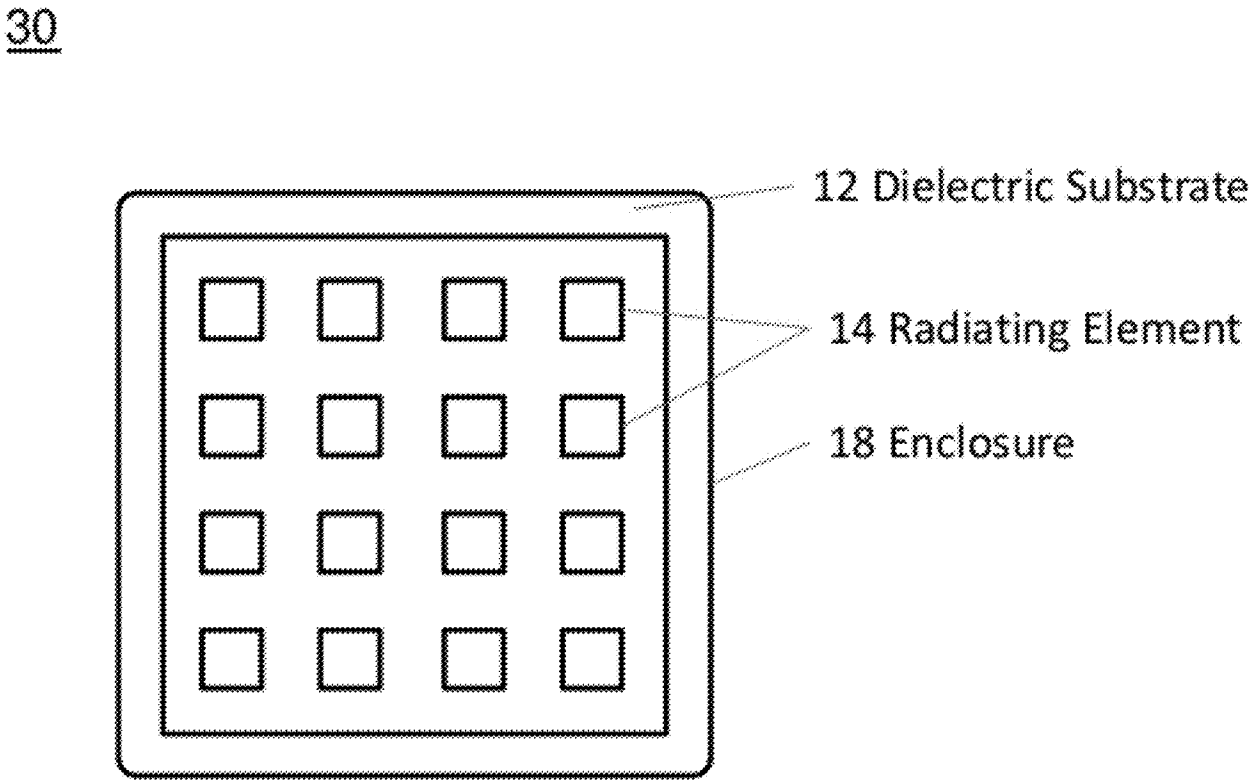
Figure 3: Directional Antenna (Prior Art)

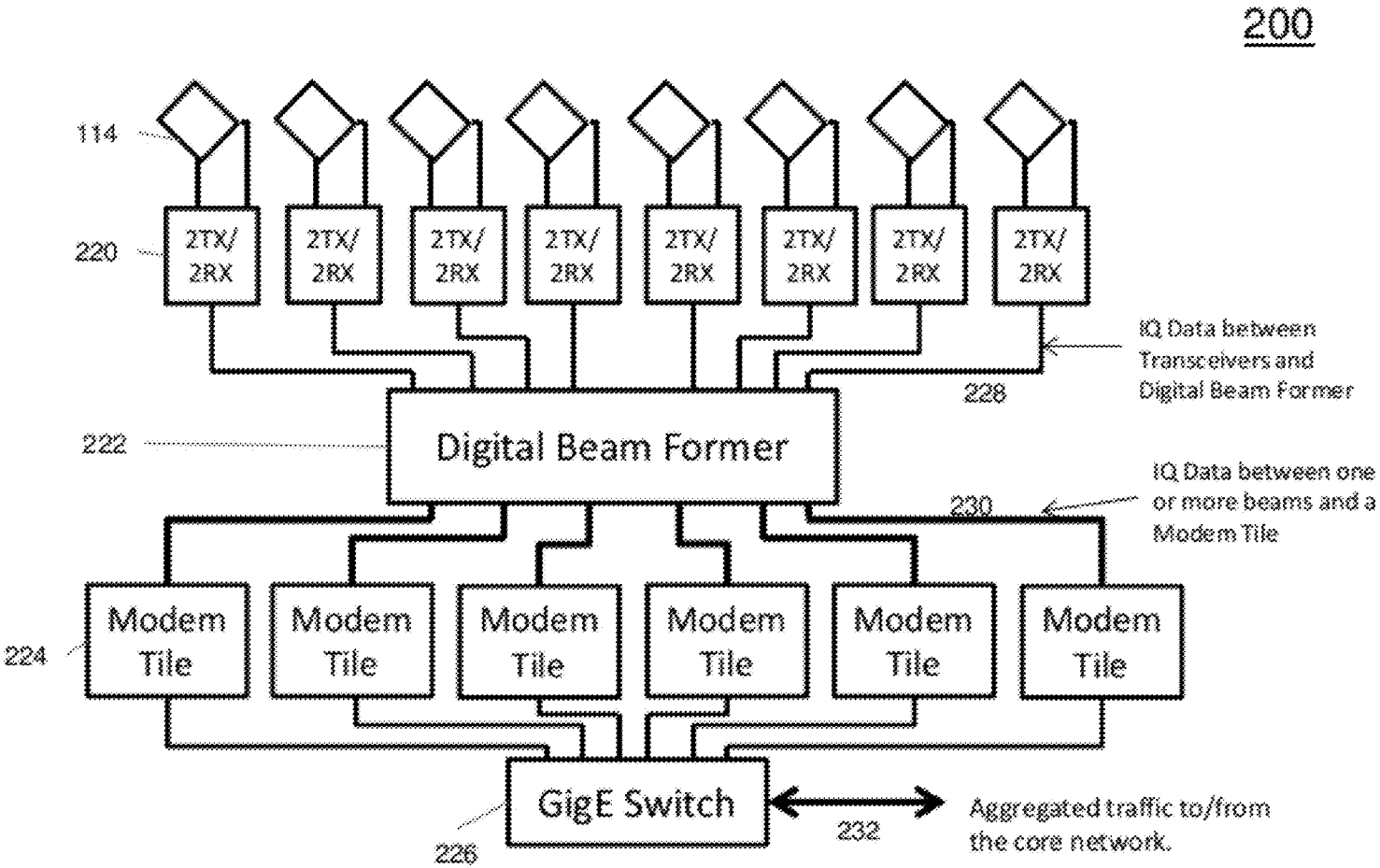
Figure 4: System Block Diagram

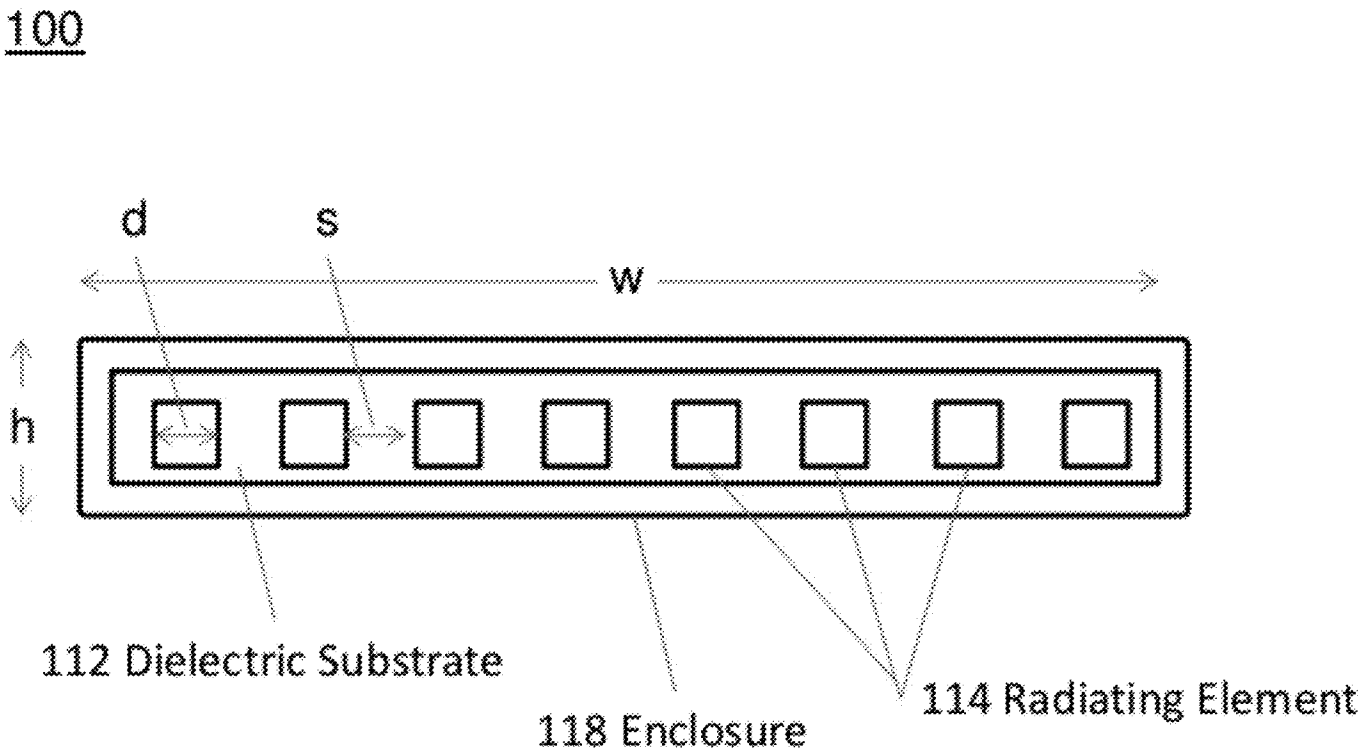
Figure 5: Small Size Beam Forming Antenna for Backhaul

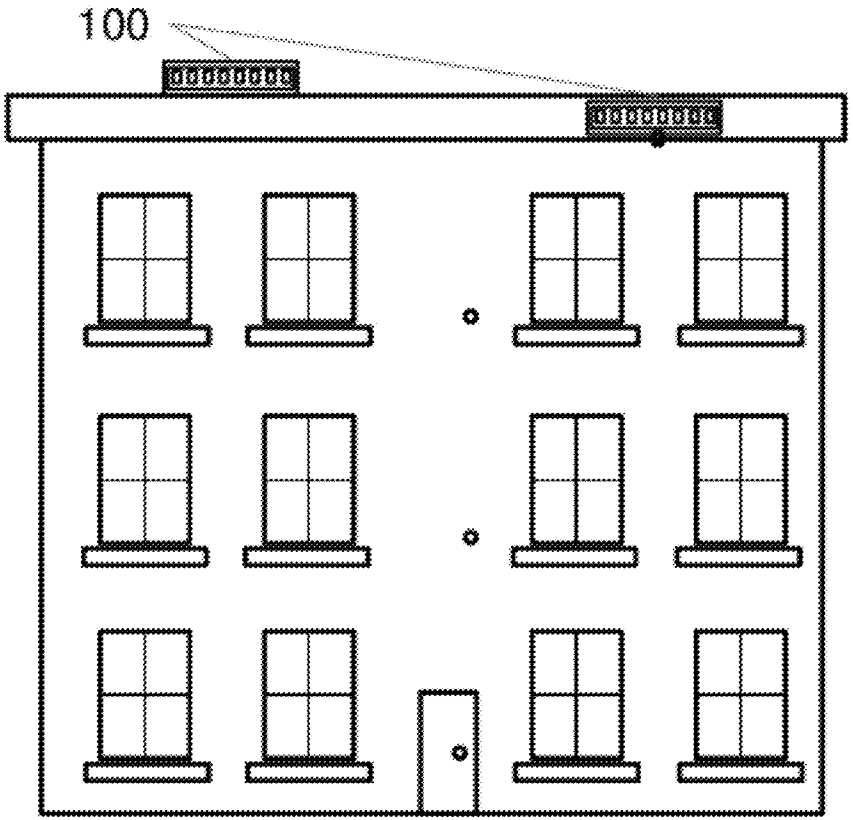
Figure 6: System Mounted Along Roof Line of Building

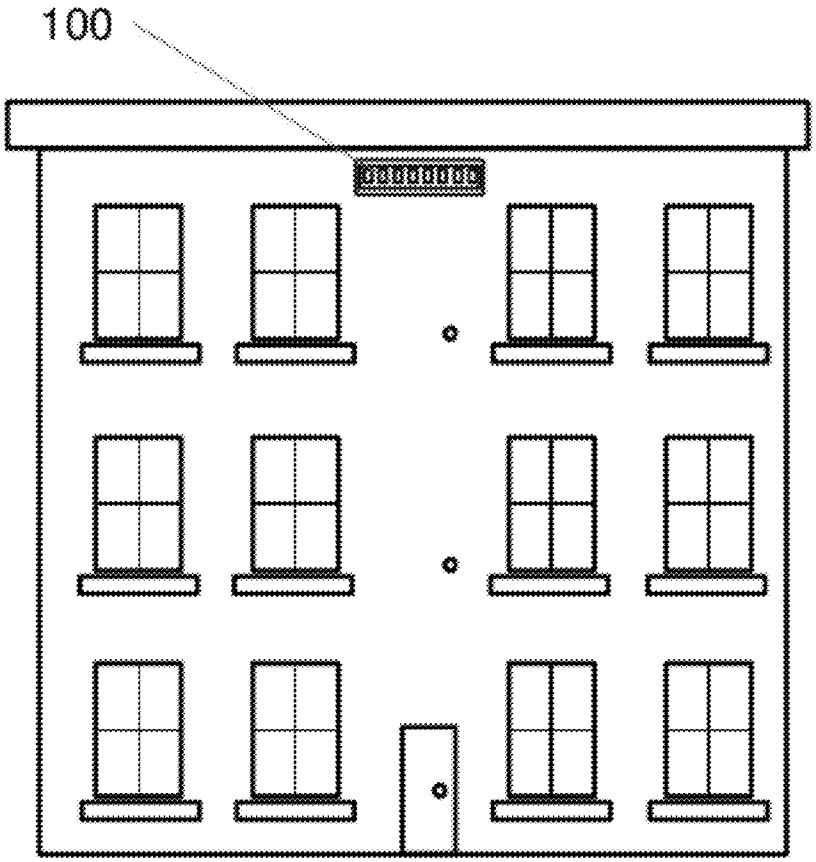
Figure 7: System Mounted Below Roof Line of Building

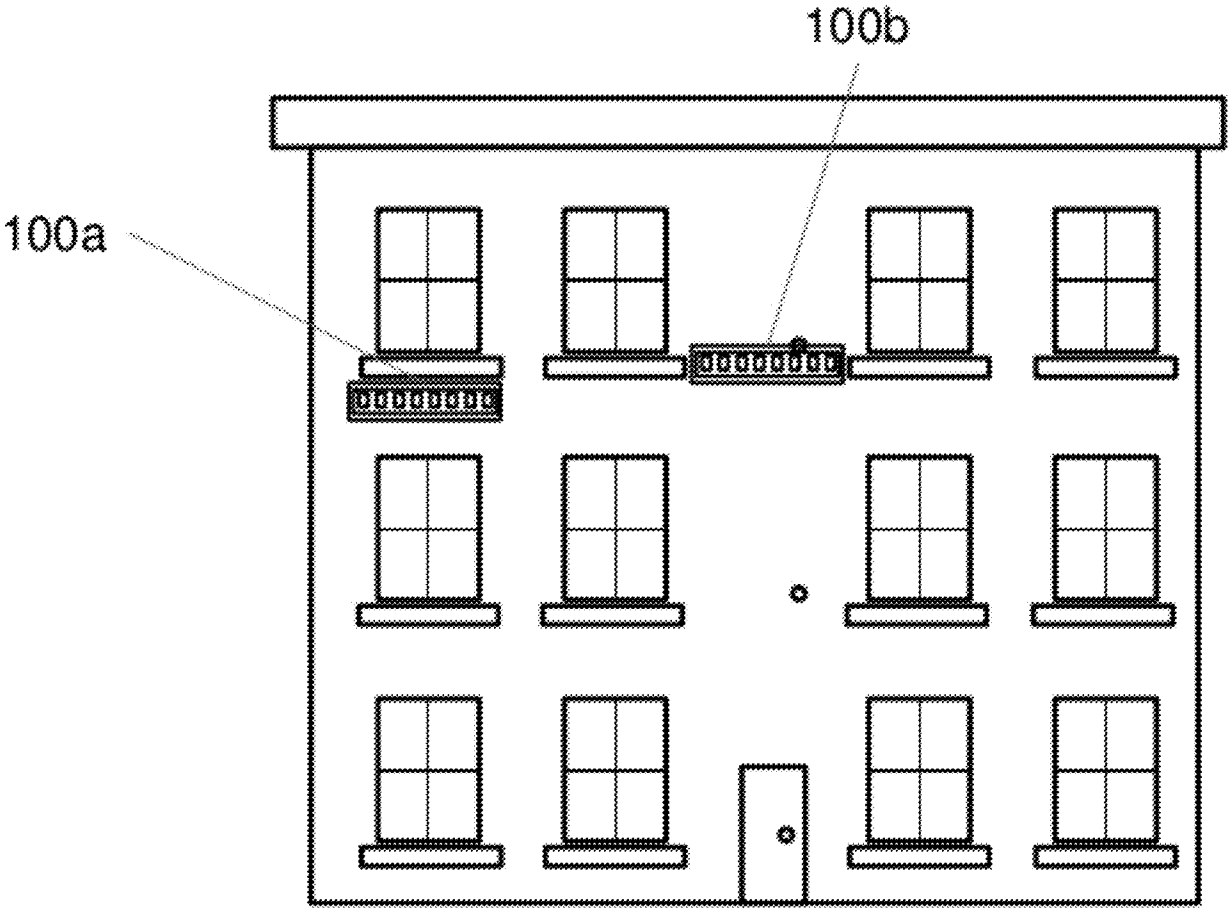
Figure 8: System Mounted in Line with or Below Window Ledge

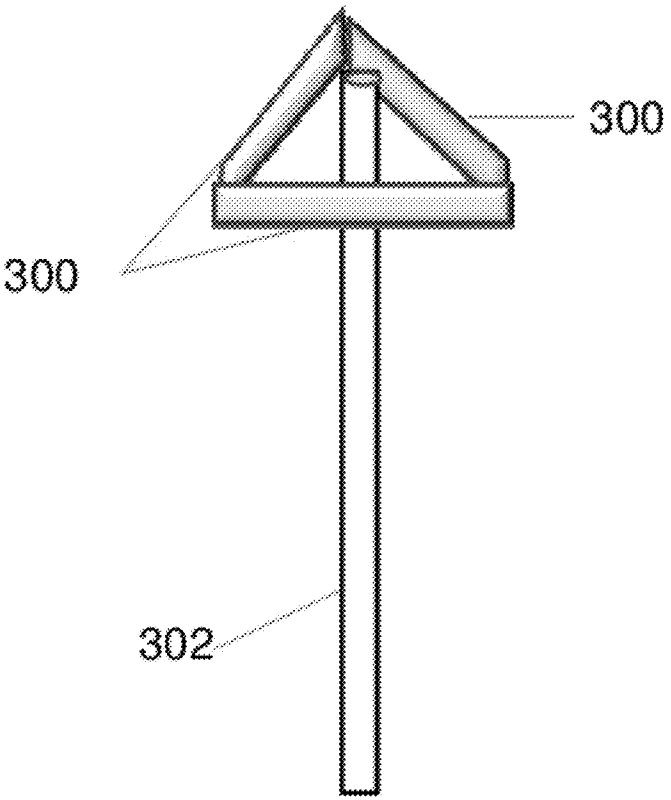
Figure 9: Three Sector System Mounted on Utility Pole

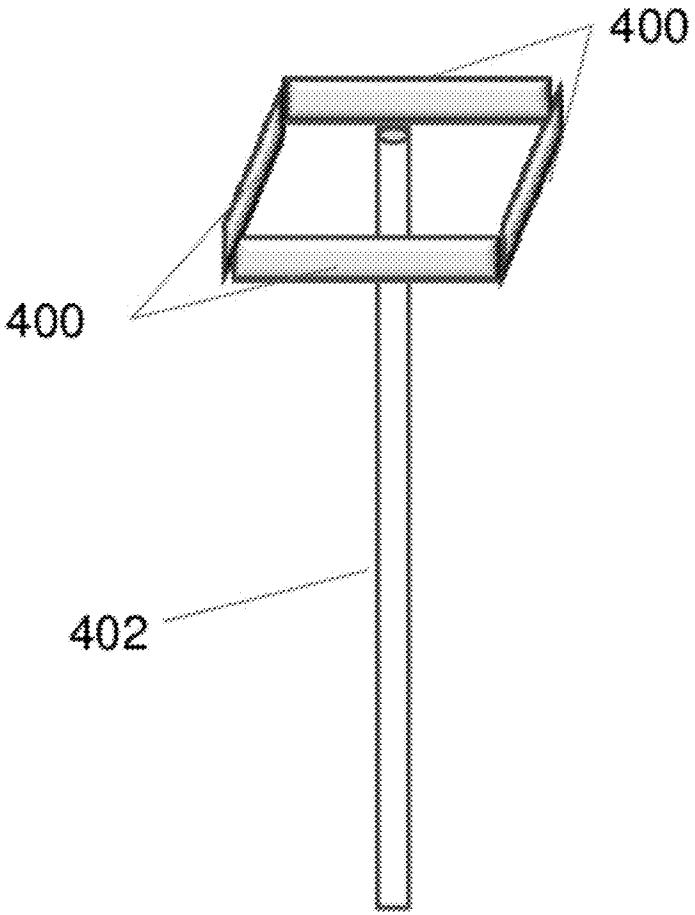
Figure 10: Four Sector System Mounted on Utility Pole

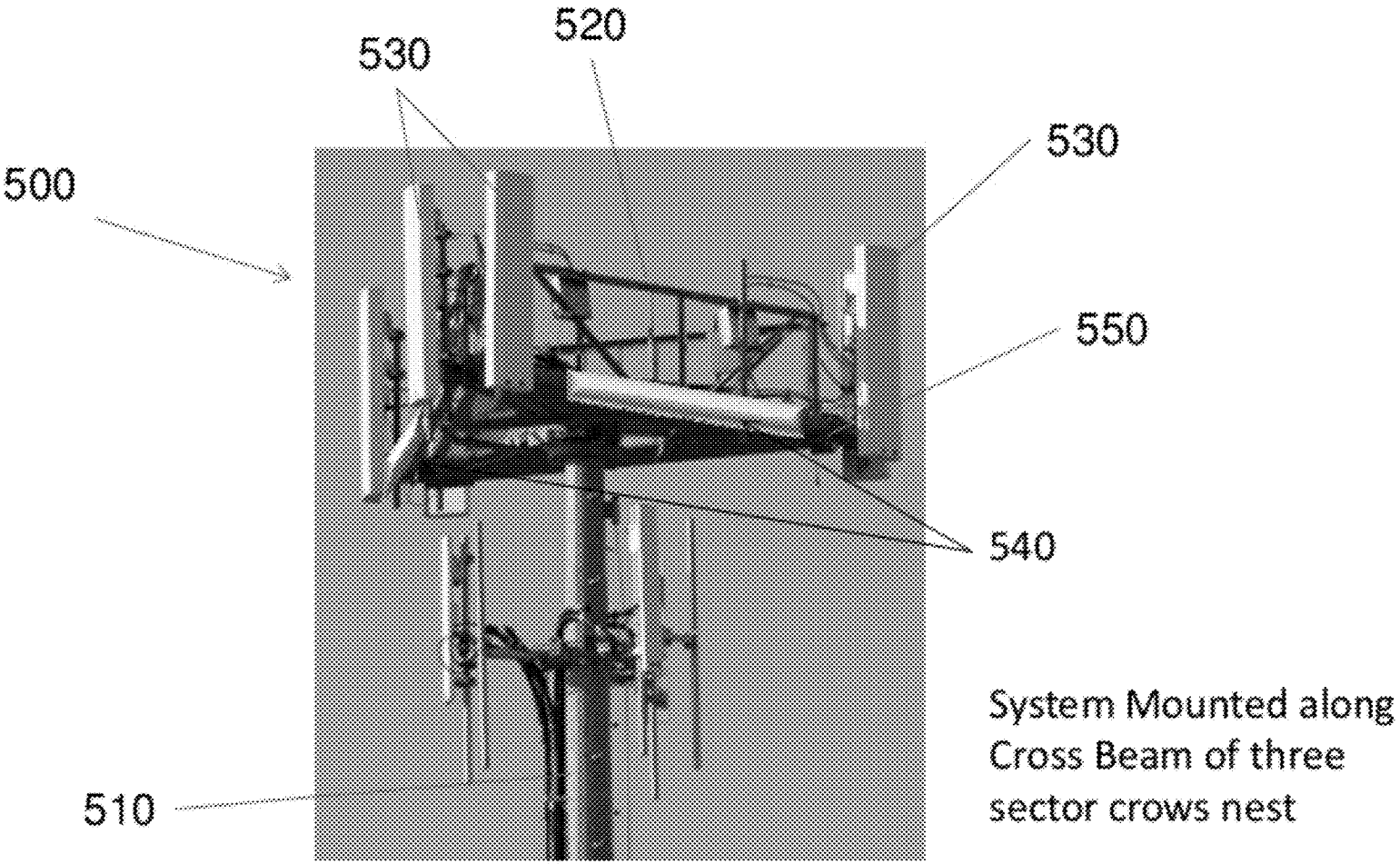
Figure 11: Three sector system mounted on cross beam of Cell Tower

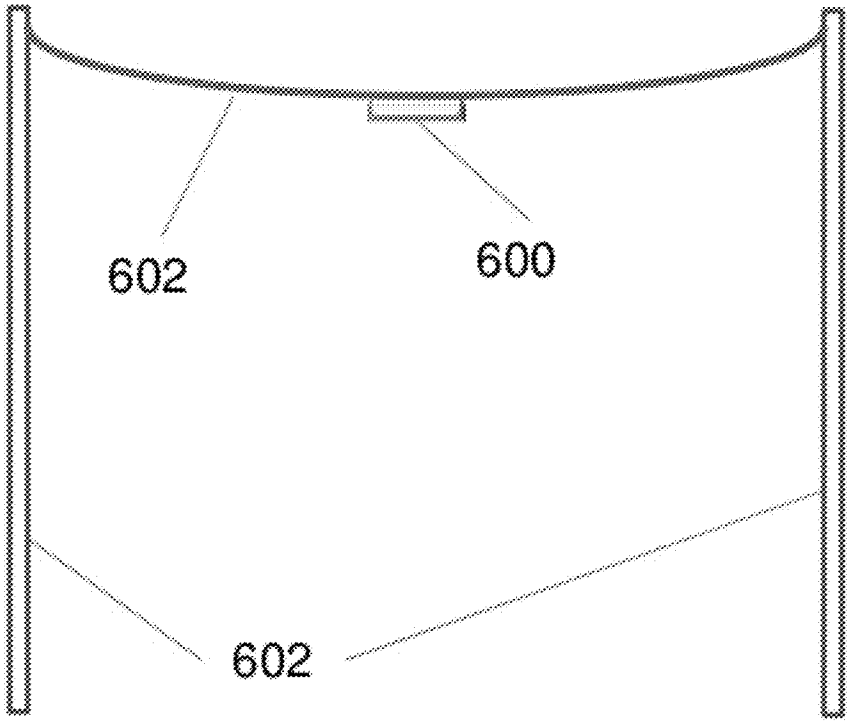
Figure 12: System Mounted on Electrical or Telephone Lines

SYSTEM AND METHOD FOR HIGH PERFORMANCE BEAM FORMING WITH SMALL ANTENNA FORM FACTOR

CROSS-REFERENCE TO RELATED APPLICATIONS

This application claims priority from U.S. Provisional application No. 61/411,033, filed 8 Nov. 2010, entitled "System and Method for High Performance Beam Forming with Small Antenna Form Factor" the entire contents of which are incorporated herein by reference.

TECHNICAL FIELD

This invention relates to wide area wireless data networks, wireless backhaul for high capacity data networks, and to antennas, systems and methods for performing beam forming, with particular application to increasing aggregate capacity and reducing interference for Non Line of Sight (NLOS) wireless backhaul in MicroCell and PicoCell networks.

BACKGROUND

Operators of wireless networks face a number of challenges in cost-effectively deploying networks resources to meet recent dramatic increases in the demand for total data capacity. This demand is being driven by the introduction of data intensive applications for smart phones, and new mobile devices with video capabilities, which in turn drive the introduction of additional data intensive applications. For example, in 2009, introduction of the iPhone® by one operator in the United States resulted in a sudden massive increase in the total traffic volume, with resultant stress on their network resources to provide the required cell site capacity to satisfy increased user demand. Other operators are seeing similar trends as they follow suit. Although cell splitting, with deployment of small cells, is an attractive option to increasing capacity, existing high capacity backhaul solutions depend on fibre and microwave and are costly to implement.

Operators have limited options to meet the increasing capacity demand with existing network technologies. If they have unused spectrum, the easiest method is to add carriers to increase the total RF bandwidth and hence the aggregate capacity of their cell sites. In many cases this can be cost effective. If they have deployed multi-carrier radios then increasing the carrier count does not require additional radios or antennas to be deployed. The disadvantage is that the additional carriers do not increase the Uplink speed since this is effectively limited by the path loss of the large cell and the limited energy per bit which a user terminal can generate.

Another option is to migrate to more spectrally efficient technologies, i.e. migration from current 3G technologies (e.g. based on CDMA and UMTS) towards next generation 4G technologies). Currently, the 3GPP LTE (Long Term Evolution) standard, which is based on MIMO/OFDMA (Multiple Input Multiple Output/Orthogonal Frequency Division Multiple Access), has emerged as the technology of choice and many operators are planning their migration from CDMA or UMTS to LTE over the next few years. Although the LTE technology is based on OFDM/MIMO, the uplink performance at the cell edge is not greatly increased, since this is still limited by the energy/bit that is required to compensate for the large path loss and the limited power which a UE (User Equipment?) transmitter is able to generate.

Moreover, as operators roll out 4G networks, they are faced with a delicate balancing act. They must invest heavily in infrastructure for a new air interface knowing that the initial subscriber density will be very low and their investment will not create significant amounts of revenue for several years. Most operators would expect their 4G investments to generate a net loss until a minimum subscriber density is achieved. To minimize the impact, an operator would likely choose to implement 4G in dense urban centers initially knowing that they will achieve a critical subscriber density relatively fast, and as these sites become profitable they would extend the coverage to increasingly less populated, less profitable areas. Although such a cautious deployment method makes sense, inter-operator competition for footprint may force operators to be more aggressive, take more risk, and deploy 4G aggressively in an effort to gain market share.

Cell splitting to increase the frequency reuse is a more powerful method and is an option even if an operator has used it entire available spectrum. The total aggregate capacity of the network increases in proportion to the number of cells. Furthermore, the user experience improves greatly since the smaller cell radius and lower propagation loss between the UE and BTS (Base Transceiver Station) means that the terminal needs to send less energy/bit and as a result can transmit over a larger bandwidth. Also, higher order modulations can be used given that a stronger signal results in a better Signal to Noise Ratio (SNR), which results in a more spectrally efficient communication link. For a fairly dense sub-urban neighbourhood the path loss exponents can be in the range of 3.5 to 4, which is to say that the path loss increases to the 4th power of the distance. So, to maintain a certain SNR at the receiver, if the distance reduces by half, the transmitter would only need to transmit $(1/2)^4=1/16$. Alternatively, for a given UE transmit power, the UE would now be able to transmit 16 times more bandwidth for a given desired SNR at the opposing receiver, which is a tremendous improvement in uplink performance. Given that Cell splitting increases both the aggregate network capacity, and the achievable uplink and downlink data rates, this option offers a very attractive deployment scenario for both existing 3G networks and the emerging 4G, LTE and WiMax networks and is expected to be a primary focus of wireless operators over the coming decade. This trend is also giving rise to a large demand for smaller lower power cell sites which are typically referred to as Pico or Micro Cells compared to the larger higher power macro cell base stations.

Two key challenges of cell splitting are site acquisition and backhaul.

Considering site acquisition, for macro-cells, the ability to cell split is restricted by the number of available towers or high-rise buildings. Furthermore, the current lease rates on a tower or high-rise building can easily run at $2 k per month or $24 k per year in developed economies. As an operator cell splits, the number of cell lease agreements and his resultant operational expenses (OPEX) fees increase proportionally. Furthermore, zoning laws may restrict the ability to build new towers and in some jurisdictions even if they allow a new tower to be built, obtaining a permit can take several years.

PicoCells offer a potential way around the site acquisition issue. As the power of the BTS and the cell radius decrease into the MicroCell or PicoCell range, the BTS can be deployed at lower elevations, for example on a utility pole. In the US the FCC has mandated that wireless operators must be given access to utility poles at a predetermined rate to facilitate this industry trend.

With respect to backhaul challenges, a 4G cell site must support data rates which will peak in the range of 100 Mbps with average data rates perhaps in the range of 10 Mbps. Peak data rates of 100 Mbps are currently only supported by fiber or by Microwave radio links. High capacity fiber links are available on major high rise buildings and on many cellular towers, but they are not available for the vast majority of utility poles where an operator may wish to deploy a PicoCell. Furthermore, supporting the peak data rates that a 4G cell site will be able to generate necessitate the operator to equip each PicoCell with a link capable of supporting a similar backhaul speed. Today, a 100 BaseT Ethernet link can cost upwards of $1500/month in the US and Canada, which results in very significant OPEX, costs ($18 k/year). If an operator decided to reduce on backhaul costs by equipping his PicoCells with DSL or Cable Modems, then the Peak data rates that can be supported will be greatly diminished and the user experience and the operator's competitive position is reduced.

Microwave radio is a cost effect means of providing a high capacity backhaul connection. A typical Microwave radio link can be installed for a one time cost of approximately $10K and recurring OPEX fee of about $2 k/link/year to the owner of the spectrum. Microwave radios can be deployed to provide a high capacity backhaul link from the BTS to an aggregation point where a high capacity fiber link is available. Given that a GigE link is only marginally more expensive than a 100 BT link, the ability to aggregate traffic to a common location provides significant savings. This is considerably cheaper than leasing a 100 BT fiber link for each BTS. The complication is that Microwave Radio operates at higher frequencies and as a result is restricted to Line of Sight (LOS) type deployments. This is not a major impediment for establishing a link between two elevated sites, which are substantially above the clutter, but it is no longer an option when the PicoCells or Microcells are deployed on lower elevation structures, below clutter, and LOS conditions no longer exist between the PicoCell and a desired aggregation point.

Thus, although cell splitting, with deployment of Microcells and PicoCells, offers advantages in increasing cell site capacity, current LOS solutions for wireless backhaul require that cell sites and aggregations points (BTS) are elevated, above the clutter. Thus backhaul remains a bottleneck for 4G, and to some extent, 3G networks. Thus it would be desirable to provide a NLOS backhaul solution, which would be capable of providing cost effective, high capacity connection/link from a Base Station (MicroCell or PicoCell) to a common aggregation point. On the other hand, there are a number of other challenges that arise in implementing a NLOS solution.

LOS Microwave antenna can be highly directional, reducing the probability of co-channel interference to a low value. NLOS Radio Links operate at lower frequencies than LOS Microwave Radio Links, and a larger path loss is expected for a given propagation distance because the signal must travel through obstructions such as buildings, trees, or around small hills. Reduced directionality, the random nature of obstructions, fluctuating path losses and beam spreading increase the probability of co-channel interference. Effective deployment of NLOS backhaul solutions therefore requires control of Carrier to Interference and Noise Ratio (CINR).

Furthermore, the availability of spectrum at lower frequencies, which can be used to implement NLOS backhaul links is scare and as such the channel bandwidth is typically limited to 10 MHz or 20 MHz whereas for a microwave link operating at higher frequencies, larger channel bandwidth of 40 Mhz or even 50 MHz are typical. As such, to effectively implement high capacity networks employing NLOS backhaul, spectral efficiency and an aggressive frequency re-use is important.

Beam forming techniques represent a promising method to increasing the frequency reuse pattern of a wireless network and thereby increase the overall capacity of the network. Beam forming has been the object of research and trials in 2G and 3G networks but has never seen widespread use due to deployment challenges. One of the largest challenges has been the size of the antenna panel which is needed to create a multi-beam system and the resultant deployment issues. Typically, a conventional sector antenna at 2.5 GHz, as represented schematically in FIG. 1, with 17 dBi of gain, will be approximately 36 inches high by 8 inches wide. These dimensions would be for a single column, with potentially two polarizations. The resultant beam pattern would have a 3 dB beam width of approximately 60 degrees in the azimuth plane and perhaps 10 degrees in the elevation plane. In order to implement a 6 beam antenna, six such antenna columns would be places on a panel as show schematically in FIG. 2, and the resultant dimensions of the panel would grow to 36 inches high, by 40 inches wide. The associated weight and wind loading of the antenna would be approximately 5 times larger. The benefit to the system designer is two-fold. Firstly, as discussed previously the antenna would now be able to create 8 distinct beams within a single sector and hence the frequency reuse pattern of the cell site can be increased, which results in a much higher capacity. The second benefit is that the system gain of the combined antenna would be about 9 dB higher than for the single column antenna, so 26 dBi, as opposed to 17 dBi for the single column antenna.

From a deployment perspective there are several issues with the large panel antenna needed to implement beam forming:

a) The size of the antenna results in significantly more wind loading on the tower than a sector antenna. Cellular towers that were originally engineered to withstand a certain amount of wind loading may not be able to support this new larger antenna.

b) The large antenna is an eyesore and it is more difficult for operators to obtain a permit to deploy such a large antenna panel.

c) Historically there have been large and expensive RF cables between the Base Station Transceiver which is on the ground and the antenna. Beam forming systems require a radio to be connected to each antenna column and hence there is a significant increase in the cost, size and weight of the RF cables.

For NLOS backhaul, given that the links are implemented between two stationary nodes, beam forming is a potentially attractive alternative to increase the frequency reuse and the overall network capacity.

An object of the present invention is to provide a wireless backhaul solution which uses beam forming and addresses at least some of the above-mentioned issues in implementing cell splitting, particularly for deployment of Microcells and PicoCells for wireless backhaul.

SUMMARY OF INVENTION

The present invention seeks to eliminate, or at least mitigate, disadvantages of these known systems and methods, or at least provide an alternative.

Thus, aspects of the present invention provide a beam forming antenna module, a beam forming antenna system and method for implementing beam forming in a wireless backhaul, or potentially, for a wireless access application.

Thus one aspect of the invention provides a beam forming panel/module for wireless backhaul, or LOS or NLOS wireless coupling of stationary nodes], comprising: a wide aperture arrangement of a plurality of radiating elements, wherein the plurality of radiating elements are arranged in an array on a panel having a large horizontal to vertical aspect ratio, and operate to provide a beam which is narrow in an azimuth plane and wide in an elevation plane The number of radiating elements in the array in the vertical direction may be 2 or less, and the number of radiating elements in the horizontal direction is 4 or more. Preferably, the number of radiating elements in the array in vertical direction is 1 and the number of radiating elements in the horizontal direction is 4 or more, or 8 or more. The module is preferably designed to include very few, or potentially a single radiating element in the vertical direction, and many elements in the horizontal direction, in order to create narrow beam in the Azimuth plane, while maintaining a small sail area.

The antenna module may further comprise a plurality of transmitters and receivers (transceivers) wherein each radiating element comprises a dual polarization radiating element coupled to respective first and second transmitters and receivers (transceivers) for excitation in two polarizations, e.g. +45 degrees and −45 degrees; a digital beam former coupled to the transceivers for sending or receiving modulated data, such as IQ modulated data, to and from the transceivers; a plurality of modern tiles coupled to the digital beam former; and a switch for aggregating the capacity of the modern tiles and providing a single backhaul interface to the network.

Preferably, the antenna is capable of implementing 2×2 MIMO in each beam.

Preferably, the respective first and second transceivers are mounted behind each radiating element, and digital signal processing elements of the digital beam former, modern tiles and switch are mounted on a board behind the panel.

In a preferred arrangement, each radiating element is spaced by one wavelength, and the antenna panel has a vertical dimension of substantially 10 cm or less, and a horizontal dimension of substantially 100 cm. Preferably, the volume of antenna panel and housing for the electronics is substantially 5 liters or less. For example, the depth of the housing is 5 cm or less. The sail area may be defined by a substantially 10 cm vertical dimension and a substantially 100 cm horizontal dimension.

In one embodiment, the antenna module or panel may provide a beam angle of up to +/−60 degrees, and for example, 3 antenna panels may be arranged on a suitable mounting for a tri sector deployment of the 3 antenna panels to provide 360 degree coverage.

In another embodiment an antenna panel provides a beam having a horizontal angle of up to +/−45 degrees, and an antenna is provided comprising 4 such antenna panels and mounting means for a four sector deployment of the 4 panels to coverage in four directions over 360 degrees.

In other deployments, the beam forming antenna comprises a mounting arrangement for inconspicuous deployment, e.g. mounting along the roof line of a building, beneath a window ledge or horizontal element of a building, or between two window ledges or horizontal elements of the building.

The beam forming antenna module may be configured for mounting the module along a substantially horizontal beam of a tower, e.g. a horizontal beam of the crows nest of a cellular tower. Alternatively, the module may be attached to an electrical or telephone cable suspended between two utility poles. A beam forming antenna system according to claim 26 capable of implementing 2×2 MIMO in each beam.

Another aspect of the invention provides a method for implementing beamforming in a wireless link for high capacity wireless backhaul or other wireless links between stationary nodes, comprising providing at each node an antenna panel comprising a plurality of dual polarization radiating elements arranged in an array with a large width to height ratio, and operating said elements to provide a beam which is narrow in an azimuth plane and wide in an elevation plane.

Preferably the method comprises digital coupling of a modern for adjusting phase and steering the beam.

Beneficially, beam forming antenna modules, systems and methods according to preferred embodiments are capable of generating directional beams and which have a small form factor and low wind loading.

Preferably, the antenna comprises an antenna panel, and digital signal processing electronics needed to form the beam accommodated in a housing that has substantially little to no impact to wind loading when mounted on substantially horizontal elements of towers or buildings, and provides improved cosmetic appearance of the building or tower on which the antenna is mounted compared with conventional vertical antenna structures.

While the novel arrangement sacrifices antenna gain, it provides digital coupling of the modern for adjusting phase and steering the beam which is beneficial for high capacity wireless backhaul, or potentially for other wireless links between stationary nodes. Conventionally this has not been done because of link budget.

Another aspect provides method of designing a radio, which includes adaptive beam forming, with a very small sail area, comprising designing the antenna panel to provide a beam which is narrow in an azimuth plane and wide in an elevation plane, preferably by designing the antenna panel comprising a plurality of radiating elements, arranged to be wider in the horizontal direction than in the vertical direction. For example, the method may comprise providing a number of radiating elements, in the vertical direction of 2 or less, and the number of radiating elements in the horizontal direction is 4 or more, and more preferably, there is a single element in the vertical direction is 1 and many radiating elements in the horizontal direction, and each element may comprise a dual polarization radiating element. The module is preferably designed to have a small height and depth to provide a slender, aesthetically pleasing form factor and/or low wind loading.

The foregoing and other objects, features, aspects and advantages of the present invention will become more apparent from the following detailed description, taken in conjunction with the accompanying drawings, of preferred embodiments of the invention, which description is by way of example only.

BRIEF DESCRIPTION OF DRAWINGS

In the drawings, identical or corresponding elements in the different Figures have the same reference numeral.

FIG. 1 shows a schematic diagram of a conventional (Prior Art) antenna for a wireless basestation;

FIG. 2 shows a schematic diagram of a conventional (Prior Art) six-column antenna panel for beam forming;

FIG. 3 shows a schematic diagram of conventional (Prior Art) directional antenna;

FIG. 4 shows a schematic system block diagram comprising an antenna module according to an embodiment of the present invention;

FIG. 5 shows schematic diagram of an antenna module according to an embodiment of the present invention;

FIG. 6 shows a system according to an embodiment of the present invention mounted along a roof line of a building;

FIG. 7 shows a system according to an embodiment of the present invention mounted along a roof line of a building;

FIG. 8 shows a system according to an embodiment of the present invention mounted below a roof line of a building;

FIG. 9 shows a system according to an embodiment of the present invention mounted in line with or below a window ledge of a building;

FIG. 10 shows a three sector system according to an embodiment of the present invention, mounted on a utility pole;

FIG. 11 shows a four sector system according to an embodiment of the present invention, mounted on a utility pole; and FIG. 12 shows a system according to an embodiment of the present invention, mounted on electrical or telephone lines between utility poles.

DESCRIPTION OF PREFERRED EMBODIMENTS

Antenna Panel Design

It is well known in the art of antenna design that there is a strong relationship between antenna gain and antenna directivity, as well as the antenna aperture. In general, an antenna with a large dimension in the vertical direction will have a relatively narrow beam in the vertical plane. Conversely, an antenna with a small dimension in the vertical plane will have a broad antenna beam in the vertical plane. The vertical plane is generally referred to as Elevation.

Similarly, an antenna with a large aperture in the horizontal direction will have a narrow beam in the horizontal plane, or azimuth. Conversely, an antenna with a small aperture in the horizontal direction will have a broad beam in the horizontal plane.

Thus, conventional antenna designs typically have a form as illustrated schematically in FIG. 1, 2 or 3. FIG. 1 shows conventional prior art a sector antenna 10 with a total of sixteen radiating elements 14 arranged on a dielectric substrate 12 to form a column 16, within enclosure 18. A typical antenna of this form has a tall aperture for more gain, and comprises an analog phasing matrix and one port for radio. The tall and narrow design (height h and width w) of the antenna would result in a beam pattern which is broad in the azimuth plane but relatively narrow in the elevation plane. FIG. 2 shows a conventional beam forming antenna panel which consists of six sector antenna columns 16, similar to that illustrated in FIG. 1, mounted together on a single panel 18. When all columns 16 are excited in phase, the antenna panel 20 is capable of generating beams which are very narrow in both the elevation and azimuth planes. FIG. 3 shows another conventional directional antenna arrangement with sixteen radiating elements 14 arranged in a 4×4 array on a dielectric substrate 12. The symmetric placement of the radiating elements would result in similar beam patterns in the elevation and azimuth planes.

For these reasons, tri-sectored base station antennas typically have a tall but narrow profile. For example a 2.6 GHz BTS antenna with 17 dBi of gain could typically be only 20 cm wide, but be over 100 cm tall. The resultant beam pattern has a 3 dB beam width of about 60 degrees in the horizontal plane, but only 10 degrees in the vertical plane. This type of antenna pattern maximizes antenna gain while radiating the energy towards the intended users. Making the antenna taller will further reduce the beam width in the vertical plane and may result in coverage holes near to the tower. Making the antenna wider will result in the beam being too narrow in the horizontal plane and energy will not cover the full 120 degrees of the sector. For a typical tri-sectored deployment the 3 dB beam width is typically 60 degrees, and at the sector edges, 120 degrees, the beam pattern can be as low as 8 to 10 dB from the peak.

The sizing and shape of antennas used for Point to Point backhaul applications follows a similar reasoning. For a point to point application the antenna need not provide a broad pattern in the horizontal plane. As such, the antenna is typically circular or square, such as shown in FIG. 3, and provides approximately the same beam width in both the horizontal and vertical planes. In this way, the antenna can provide maximum gain or effective area, with the broadest beam width. For a desired antenna gain, this results in an antenna which is easiest to align. If the antenna were made taller and narrower, the same gain could be achieved but the antenna would receive signals from a wider angle in the horizontal plane and the system would suffer more interference. If the antenna were made wider but less tall, the beam would be very narrow in the horizontal plane and the antenna would be very difficult to align.

For Backhaul applications, we are not so concerned with the Link Budget or range of the link for several reasons. Firstly, both modules benefit from reasonably high antenna gain, as opposed to access links where the customer terminal has an antenna with a very low gain, typically 0 dBi. Having high antenna gain on both modules can provide upwards of 15 dB of link budget. Secondly, both modules are elevated and as such the RF signal does not need to travel through as much clutter. As a result, the propagation loss, even for NLOS Systems, is less lossy than for an access link to a user where the antenna of the cell phone is just 1.5 m off the ground. The reduced path loss can be as much as 10 dB for a comparable distance. In some instances where the backhaul link is actually Line of Sight, then the propagation loss can be ever lower. Finally, given that both ends of the backhaul link are stationary, we do not need to allow for shadow margin. It is not unusual to provide up to 2 standard deviations of shadow margin in an access link budget to obtain the desired coverage level and to ensure that the link does not drop as the user moves throughout the cell. For backhaul applications, the nodes do not move and we can select sites which are not heavily shadowed. The reduced need for shadow margin can account for nearly 18 dB of path loss if we base ourselves on the SUI Category B propagation model. These three factors together combine to provide up to 42 dB of improved RSSI at the receiving backhaul module compared to an access link of similar length.

Capacity however is our primary concern. Given the scarcity of RF spectrum, and the need to provide a very dense, high capacity deployment of 4G pico- or micro-cells, it is desirable to increase the frequency reuse as much as possible. If we combine this with the realization that the link budget is not as critical for backhaul as it is for access, then we conclude that a novel unique antenna topology would be very long in the horizontal direction, but very narrow in the vertical direction. In the extreme, the antenna would only constitute one antenna element in the vertical direction but multiple elements, e.g. between 2 and up to 64 elements in the horizontal direction. The number of elements in the horizontal direction would depend on the beam width in the azimuth plane that we are targeting all the while realizing that the cost and complexity go up with the number of elements.

Thus, an antenna system according to a preferred embodiment of the present invention comprises an antenna panel/module having a form factor with a large horizontal to vertical aspect ratio.

FIG. 5 shows schematically an 8 element beam forming antenna panel 100 according to a preferred embodiment, comprising eight radiating elements 114 arranged on dielectric substrate/panel 112, in enclosure 118.

As shown schematically in the block diagram of FIG. 4 the antenna system 200 comprises eight dual-polarization radiating elements 114, sixteen transmitters TX and sixteen receivers RX, 220, a digital beam former 222 and six modern tiles 224

Referring to FIG. 4, this particular implementation has 8 radiating elements 114, where each element is excited in two polarizations, +45 and −45 degrees. Each radiating element is therefore connected to two transmitters and two receivers 220, one for each polarization. There are thus a total of 16 transmitters and 16 receivers in the module.

The transceivers include the full up and down converters, Power Amplifiers, Low Noise Amplifier, RF Filters, Voltage Controlled Oscillators as well as the Digital to Analog Converters (DACs) and Analog to Digital Converters (ADCs). The transmitters accept Digital IQ data 228 and generate an RF signal which is transmitted to the Antenna. The receivers take in an RF signal from the Antenna and produce a Digital IQ data stream 228. The transceivers can either be designed for Frequency Division Duplex (FDD) or Time Domain Duplex (TDD) implementation.

IQ modulated data 228 to or from the transceivers is provided to a Digital Beam Former. The digital beam former 222 adjusts the amplitude and phase of the signals to or from each transceiver 220, in a way as to obtain a desired beam when all antenna elements are combined. In this scenario, the beams will be creating elements from the same polarization. Different Polarizations will be kept separate to allow 2×2 MIMO across beams of different polarization. The beam forming is performed in both the uplink and the downlink directions. In the Uplink (Receiving) direction, the Beam former provides the IQ data 230 of one or more beams to a Modem Tile 224. The Modem Tile 224 effectively includes the functionality of a Modem for a typical system capable of performing 2×2 MIMO. The channel bandwidth is configurable according to the WiMax or LTE standards, or potentially any other channel bandwidth could be accommodated. Additional Modem Tiles 224 can be added to the module to increase the capacity. If the beam can be created with sufficient isolation, the Modems can effectively operate on separate beams and independently from one another. This allows a very large capacity increase from a total system perspective.

A Gigabit Ethernet switch 226, or potentially a 10 GigE Switch is used to aggregate the capacity of all the Modem tiles 224 and provide a single backhaul interface 232 to the network.

FIG. 5 shows the antenna module form factor. Eight radiating elements 114 are shown across the width of the module 100. In this case, the radiating elements are oriented to excite either Veridical or Horizontal Polarization depending on whether the feed is horizontal or vertical respectively. Polarizations of +45 or −45 degrees could be achieved by rotating the patches by 45 degrees. In practice, the radiating elements 114 would be covered by a radome and not visible, but we have shown them in the drawing for the sake of explanation. The electronics are located behind the antenna panel 112. Two transceivers 220 are located directly behind each radiating element 114. The digital signal processing, which includes the Digital Beam former 222, Modems 224 and GigE Switch 226 are located on a separate board.

The interesting aspect of FIG. 5 is that we have effectively created a module with 8 antenna columns, in a very small and therefore relatively inconspicuous arrangement. This provides advantages with respect to wind-loading, and also tends to provide a more aesthetically pleasing form factor.

At 2.6 GHz, using a dielectric substrate with $\epsilon_0$=3.4, the dimension (d) of the radiating element would be approximately 3.1 cm×3.1 cm. Allowing extra space for the ground plane, mechanical enclosure and electronics, it is conceivable that the module would not need to be more than 10 cm high (h). For the width (w), the module size is governed primarily by the number of radiating element we wish to have as well as the spacing between radiating elements. For this module, if we have 8 radiating elements, spaced by 1 wavelength, the distance between the two furthest radiating elements would be 92 cm or 36 inches. Allowing space for the enclosure design the module need not be more than 100 cm wide. Finally, the depth would be governed mainly by the volume required to place the electronics.

Assuming the transceivers 220 are low power, and we are transmitting no more than 1 Watt per radiating element, it should be feasible to fit the electronics in a 5 liter volume, hence the depth of the module would probably be no more than 5 cm. As such, we now have a high capacity backhaul module, capable of creating multiple beams with a very modest 5 liter volume, and very small sail area of 10 cm×100 cm, which is actually less, about half, than most sector antennas used for base stations today. The number of radiating elements 114, and the spacing (s) of the radiating elements, will depend on the width and shape of the beams we desire to create. The larger the number of elements, the narrow the beam which we can create, and hence a larger frequency reuse pattern can be used, and hence the system is capable of generating higher capacities.

Advantageously, the novel form factor of the antenna module allows for reduced wind loading, and relatively inconspicuous mounting compared with conventional antenna panels. Given the size and shape of the module, all kinds of new, more cosmetically pleasing deployment configurations become possible. For example, the antenna modules may be mounted along horizontal structures of a building, at the roofline, under window ledges, such as illustrated in the exemplary arrangements represented in FIGS. 6 to 8. The wide, low form also allows for novel configurations of antenna systems mounted on conventional towers, utility poles or utility line and cables, as represented in FIGS. 9 to 12, which provide reduced wind loading.

Given the size and shape of the module, all kinds of new, more cosmetically pleasing deployment configurations become possible. FIG. 6 shows two potential deployments where the module 100 is mounted directly above the roof line, or along the roof line of a building. Given that the module is placed along a major edge of the building, and is effectively oriented in the same direction as the roof line, it is very inconspicuous. The module is therefore much less of an eyesore than a sector antenna which would be sticking up vertically above the roof line of a building, and very significantly less visible than a large antenna panel typically used for implementing beam forming on base stations.

FIG. 7 shows the module 100 deployed directly below the roof line of a building. In some instances where the roof extends outward relative to the wall, the module would be extremely inconspicuous. FIG. 8 further shows the module 100*a* mounted directly below the window ledge. Once again, given that the window ledge is a long narrow horizontal structure with a similar shape as the proposed module, the module fits in nicely and is rather inconspicuous when placed under the window ledge. An alternative deployment would be to place the antenna 100*b* in line with two window ledges, so that it looks like a natural feature of the building. FIG. 9 shows a three sector deployment on a Lamp or Utility Pole. The module 300 is capable of forming a beam within an angle of +/−60 degrees. If full 360 degree coverage is desired, an arrangement of three modules 300 at 120 degree offsets is desirable. If all three modules are mounted around the post in the form of an equilateral triangle, the design is symmetric and esthetically pleasing. In this scenario a special mounting bracket needs to be developed to fix the three modules to the post 302, at proper angles to one another. FIG. 10 shows a 4 sector deployment, e.g. on pole 402. The four sector deployment would be particularly attractive at the intersection of two roads, for example. One module 400 is used to radiate RF beams and provide coverage along each road direction. Similarly to the three sector deployment, the symmetry of the modules is esthetically pleasing and looks good when mounted on a pole.

For three sector or four sector deployments on poles, it would be possible, for example, to incorporate one or more light fixtures in the mounting bracket, at the corners where the modules meet for example. In this fashion, the modules would look as though they are part of an outdoor lighting structure or fixtures, and would potentially be more acceptable to nearby residents.

FIG. 11 shows a typical cellular tower 500. A mast or tower 510 is used to provide elevation. A crows nest 520 is used to provide a platform where technicians can work and install equipment. Along the crows nest, the antennas are installed. The crows nest shown here is triangular to support a three sector deployment. On each side of the crows next are mounted two Sector Antennas 530 to provide spatial diversity. Our proposed module 540 is mounted along the I-Beam 550 of the crows next. In this manner, it does not contribute any significant additional amount of wind loading, since the I-beam was already obstructing the wind, and the module 540 is very inconspicuous against the beam. One module 540 can be placed on each side of the crows nest to provide a very high capacity hub to backhauling applications.

A cellular tower with three backhaul hubs comprising an antenna structure according to a preferred embodiment provides an advantageous method of deploying a very high capacity 4G network. Very high speed fiber backhaul can be provisioned at the tower. On each sector, one the modules is provided, capable of generating 6 beams, as an example. For a 20 MHz carrier, where we implement 2×2 MIMO in each beam, we are capable of generating approximately 168 Mbps per beam. Assuming that we are able to reuse all the resource blocks in each beam, the total aggregate capacity of the module could be as high as 1008 Gbps per module. If we combine the capacity of all three modules, the tower is now capable of supporting up to 3 Gbps of capacity and feeding a very large number of Pico cells in the vicinity.

FIG. 12 shows a module 600 mounted along an electrical or telephone line 602, between two utility poles 602. The long slender shape, and light weight, of the module 602 makes it a good candidate for mounting on suspended electrical or telephone cables. Typically, the side to side rocking of the cables, which would cause the module to sway back and forth, and tilt in the vertical plane, would be a large problem for a module with a relatively narrow beam in the elevation plane. For this module, since the beam is very wide in the elevation plane, a small amount of tilting back and forth is not an issue. The module is more sensitive to side to side rocking since this would rotate the beam in the Azimuth plane, where the beams in this plane are very narrow. By attaching the module at the two extremities to a suspended cable, there would be little side to side rocking. Power and copper or fiber backhaul can be extended to the module by wrapping these cables around the suspended cable.

Industrial Applicability

An antenna, system, and method for high performance beam forming are provided. The novel form factor of the antenna, with a small antenna sail area, and large horizontal to vertical aspect ratio, advantageously provides for reduced wind loading, and for less conspicuous installations on buildings or towers, for example. The antenna design is particularly suited to applications in LOS and NLOS backhaul applications.

Although embodiments of the invention have been described and illustrated in detail, it is to be clearly understood that the same is by way of illustration and example only and not to be taken by way of limitation, the scope of the present invention being limited only by the appended claims.

The invention claimed is:

1. A beam forming antenna module for a wireless backhaul network for LOS or NLOS wireless coupling of stationary nodes of the network , comprising:

a wide aperture arrangement of a plurality of radiating elements, wherein the plurality of radiating elements are arranged in an array on a panel having a large horizontal to vertical aspect ratio, and operate to provide a beam which is narrow in an azimuth plane and wide in an elevation plane;

each radiating element comprising a dual polarization radiating element coupled to respective first and second transmitters and receivers (transceivers) for excitation in two polarizations;

a digital beam former coupled to the transceivers for sending or receiving modulated data to and from the transceivers;

a plurality of modem tiles coupled to the digital beam former;

and a switch for aggregating the capacity of the modem tiles and providing a single interface to the network; and wherein the respective first and second transceivers are mounted behind each radiating element, and digital signal processing elements of the digital beam former, modem tiles and switch are mounted on a board behind the panel.

2. A beam forming antenna module according to claim 1, wherein the number of radiating elements in the array in the vertical direction is 2 or less, and the number of radiating elements in the horizontal direction is 4 or more.

3. A beam forming antenna module according to claim 1, wherein the number of radiating elements in the array in vertical direction is 1 and the number of radiating elements in the horizontal direction is 4 or more.

4. A beam forming antenna according to claim 1 wherein the two polarization-comprise +45 degrees and −45 degrees.

5. A beam forming antenna module according to claim 1 where the number of radiating elements in the array in the vertical direction is 1 and in the horizontal direction is 8.

6. A beam forming antenna module according to claim 5 wherein each radiating element is spaced by one wavelength and the antenna panel have a vertical dimension of substantially 10 cm or less, and an horizontal dimension of substantially 100 cm.

7. A beam forming antenna module according to claim 6 wherein the volume of antenna panel and housing for the electronics is five liters or less.

8. A beam forming antenna module according to claim 7 wherein the depth of the housing is 5 cm or less.

9. A beam forming antenna according to claim 1 for providing a beam angle of up to +/−60 degrees.

10. A beam forming antenna module according to claim 9 comprising 3 antenna panels and mounting means for a tri sector deployment of the 3 antenna panels to provide 360 degree coverage.

11. A beam forming antenna module according to claim 1 for providing a beam having a horizontal angle of up to +/−45 degrees.

12. A beam forming antenna module according to claim 11 comprising 4 antenna panels and mounting means for a four sector deployment of the 4 panels to coverage in four directions over 360 degrees.

13. A beam forming antenna module according to claim 1 capable of implementing 2×2 MIMO in each beam.

14. A beam forming antenna module according to claim 1 wherein the sail area defined by a substantially 10 cm vertical dimension and a substantially 100 cm horizontal dimension.

15. A beam forming antenna module according to claim 1 wherein the height of the array is less than 10 cm.

16. A beam forming antenna module according to claim 1 wherein the panel accommodates electronic components behind the panel in a depth of substantially less than 5 cm.

17. A beam forming antenna module according to claim 1 comprising mounting means for inconspicuous deployment along the roof line of a building.

18. A beam forming antenna module according to claim 1 comprising mounting means, for inconspicuous deployment mounted beneath a window ledge or horizontal element of a building, or between two window ledges or horizontal elements of the building.

19. A beam forming antenna module according to claim 1 comprising means for mounting the module along a substantially horizontal beam of a tower.

20. A beam forming antenna module according to claim 1, comprising means for mounting the module along a substantially horizontal beam of the crows nest of a cellular tower.

21. A beam forming antenna module according to claim 1 comprising means for attachment to an electrical or telephone cable suspended between two utility poles.

22. A beam forming antenna module according to claim 1 wherein the antenna panel comprises mounting means, and further comprises a light fixture.

23. A beam forming antenna system for a wireless backhaul network for wireless coupling of stationary nodes of the network, the system comprising a plurality of antenna modules, each antenna module having an antenna panel comprising a plurality of radiating elements arranged in an array having wherein the number of radiating elements in the array in the vertical direction is 2 or less, and the number of radiating elements in the horizontal direction is 4 or more, that operate to provide a beam which is narrow in an azimuth plane and wide in an elevation plane, wherein each radiating element is a dual polarization radiating element;

a plurality of transmitters and receivers (transceivers) wherein each radiating element is a dual polarization radiating element coupled to respective first and second transmitters and receivers (transceivers) for excitation in two polarizations;

a digital beam former coupled to the transceivers for sending or receiving modulated data to and from the transceivers;

a plurality of modem tiles coupled to the digital beam former;

a switch for aggregating the capacity of the modem tiles and providing a single backhaul interface to the network; and wherein the respective first and second transceivers are mounted behind each radiating element, and digital signal processing elements of the digital beam former, modem tiles and switch are mounted on a board behind the panel.

24. A beam forming antenna system according to claim 23 capable of implementing 2×2 MIMO in each beam.

25. A beam forming antenna system according to claim 23 comprising support means supporting three of said antenna modules in an equilateral triangular pattern around a pole, to provide a three sector deployment configuration.

26. A beam forming antenna system according to claim 23, further comprising support means supporting four of said antenna modules in a square arrangement around a pole, to provide a four sector deployment configuration.

* * * * *